US006401860B1

(12) United States Patent
Ellington et al.

(10) Patent No.: US 6,401,860 B1
(45) Date of Patent: Jun. 11, 2002

(54) COUGH SILENCER DEVICE

(75) Inventors: R. Craig Ellington, Loganville; Stephen D. Ellington, Social Circle; Rhett P. Rush, Lula, all of GA (US)

(73) Assignee: Ellington & Rush Hunting Products, Inc., Lula, GA (US)

( * ) Notice: Subject to any disclaimer, the term of this patent is extended or adjusted under 35 U.S.C. 154(b) by 0 days.

(21) Appl. No.: 09/690,945

(22) Filed: Oct. 18, 2000

(51) Int. Cl.[7] ..... G10K 11/12
(52) U.S. Cl. ..... 181/242; 181/21
(58) Field of Search ..... 181/21, 242, 252, 181/256, 258, 255, 272, 211

(56) References Cited

U.S. PATENT DOCUMENTS

| | | | | |
|---|---|---|---|---|
| 3,796,842 A | | 3/1974 | Guille | |
| 4,396,089 A | | 8/1983 | Scully | |
| 4,834,212 A | | 5/1989 | Figone et al. | |
| 4,932,495 A | | 6/1990 | Chapman | |
| 5,413,094 A | | 5/1995 | McBrearty | |
| 5,434,374 A | | 7/1995 | Hsueh | |
| 5,910,772 A | | 6/1999 | Hui | |
| 6,085,864 A | * | 7/2000 | Copeland et al. | 181/242 |

* cited by examiner

*Primary Examiner*—Khanh Dang
(74) *Attorney, Agent, or Firm*—Hinkle & O'Bradovich, LLC

(57) ABSTRACT

A cough silencer device comprising a body having a cavity therein with a mouth portion on a first end and an open second end. An internal muffling baffling system is placed within the cavity of the body and is fluidly connected to the mouth portion. An end cap is attachable to the open second end of the body to retain the internal muffling baffling system within the cavity. A person can insert the mouth portion into their mouth and cough allowing the internal muffling baffling system to silence the cough. The cough silencer device can further include an elongate tube having a first end attached to the mouth portion of the body. A mouthpiece is affixed to a second end of the elongate tube, so that the mouth of the person can engage the mouthpiece.

4 Claims, 4 Drawing Sheets

COUGH SILENCER DEVICE

BACKGROUND OF THE INVENTION

I. Field of the Invention

The present invention relates generally to the field of sound deadening equipment. More particularly, the invention comprises a cough silencer device.

In general, a first field of use of the disclosed invention is by hunters, as the most likely benefactors of the unique advantages of the instant invention. However, many other fields, such as for use by enraged persons, bird watchers, audience members and the like, could find potentially beneficial uses of this invention.

Thus, it can be seen that the potential fields of use for this invention are myriad and the particular preferred embodiments described herein is in no way meant to limit the use of the invention to the particular field chosen for exposition of the details of the invention.

A comprehensive listing of all the possible fields to which this invention may be applied is limited only by the imagination and is, therefore, not provided herein. Some of the more obvious applications are mentioned in the interest of providing a full and complete disclosure of the unique properties of this previously unknown general purpose article of manufacture. It is to be understood from the outset that the scope of this invention is not limited to these fields or to the specific examples of potential uses presented herein.

II. Description of the Related Art

Various devices are well known in the prior art which deal with muffling sounds. These devices can be placed over the mouth and into which a person may yell, scream, cough or sneeze, so as to deaden such sounds. However, no one patent fully shows each and every aspect of the invention.

Sound deadening equipment are shown in U.S. Pat. No. 3,796,842 issued to Eric L. Guille on Mar. 12, 1974; U.S. Pat. No. 4,396,089 issued to Monya Scully on Aug. 2, 1983; U.S. Pat. No. 4,834,212 issued to Moira J. Figone et al. on May 30, 1989; U.S. Pat. No. 4,932,495 issued to Dewey R. Chapman on Jun. 12, 1990; U.S. Pat. No. 5,413,094 issued to Edward McBrearty on May 9, 1995; and U.S. Pat. No. 5,434,974 issued to Tien-Chu Hsueh on Jul. 18,1995.

U.S. Pat. No. 3,796,842 to Guille discloses a dictation mask. The dictation mask adaptable for use by a court reporter, or the like, is electrically connected to a recording apparatus for recording the voice of the dictator. A generally spherically-shaped member provides an area for fitting on the face of the dictator and includes a plurality of chambers serially in communication by means of sole apertures. Certain of the chambers have muffling coils mounted therein for receiving the breath and voice of the dictator and muffles the sound therefrom. Each such muffling coil is provided with a plurality of spaced-apart breath exhaust passages. The spherically-shaped member is provided with a handle. The handle provides one of the plurality of chambers. The dictation mask includes a moisture-absorbing means.

U.S. Pat. No. 4,396,089 to Scully discloses a sound muffling cup. The invention is directed to provided a sound muffling cup into which an enraged person can shout to release tension while avoiding disturbing other persons. The cup comprises an elongated body portion having a substantially closed end wall at one end, and brim shaped to provide a mouthpiece at the other end. The body portion is of a size such that the fingers can be at least partially wrapped around the body portion for holding of the cup, and the mouthpiece is of a size and contour such that it can be placed over the mouth with substantially the entire brim contacting the skin along a generally elliptical line spaced from the lips and on the mouth side of the nose and chin.

U.S. Pat. No. 4,834,212 to Figone et al. discloses a sound muffler for covering the mouth. It is ahuman sound muffler and indicator for placement around the mouth of a user to absorb most of the sound emanating from the user's mouth. It includes a microphone and associated electrical circuit for receiving unabsorbed sound and provides an indication of the intensity of the unabsorbed sound.

U.S. Pat. No. 4,932,495 to Chapman discloses a vocal sound muffling device. The vocal sound muffling device having an elongated tubular body provides an elongate tubular cavity. A mouthpiece on one end of the body provides an inlet into the cavity for vocal sound waves and atomized fluids. A closure on the other end of the body having a fluid outlet therein is for regulating fluid flow from the cavity. Cellular material is in the cavity intermediate the inlet and outlet for attenuating the vocal sound waves.

U.S. Pat. No. 5,413,094 to McBrearty discloses an apparatus for reducing the noise of coughs and sneezes. The apparatus for reducing the noise of coughs and sneezes is placed over the nose and mouth of the user. The apparatus has a core with a recessed portion to fit over the mouth and nose of the user and the core is made of a noise reducing material. A cover surrounds the core and has a section of absorbent material positioned over the recessed portion of the core. The noise reducing material of the core is a foamed resin. Vent holes are provided on the cover to allow the air forced into the core to exit the core and for the removal of moisture. A strap is attached to the cover to allow the user to wear the apparatus about the user's person until upon need, the apparatus is placed over the mouth and nose to reduce the noise of a cough or sneeze.

U.S. Pat. No. 5,434,374 to Hsueh discloses a detachable filter and muffler device. This invention relates to the detachable filter and muffler device used in an exhaust system. The filter and muffler device is easily detachable so that the maintenance of the exhaust system is simplified, and the cost of maintenance is reduced.

The present invention is completely different than these patents in that it consists of a cough silencer device. The invention concerns a device for use by hunters in the woods so that if the hunter has to cough while hunting, a portion of the device would be put to the hunter's mouth and, upon coughing, the cough noise would be silenced by the device. The device comprises three main parts, a body, an internal muffling baffling system and an end cap. There is an alternative embodiment, being an elongate tube and mouthpiece attached thereto.

None of the above inventions and patents, taken either singly or in combination, is seen to describe the instant invention as claimed. Accordingly, the invention a cough silencer device will overcome the shortcomings of the prior art devices.

SUMMARY OF THE INVENTION

In accordance with the present invention and the contemplated problems which have and continue to exist in this field, the present invention refers to a cough silencer device that consists of three major parts. The first part is the body of the device, the second part is the internal muffling baffling system and the third part is the end cap, which willows access to the internal parts of the device, so as to be taken apart for cleaning. An alternative fourth part is an elongate tube and mouthpiece. Obviously, a mouth portion of the body itself is put to the hunter's mouth so that the hunter may cough into the mouth portion, thereby silencing the cough to prevent noise escaping and scaring the game away. The baffling system is for reducing sound. It is contemplated that the baffling system will have a fibrous material (such as cotton) interspaced between baffling discs to assist in silencing the noise. Since the fibrous material is removable, the device could be used with or without the fibrous material. The elongate tube and mouthpiece is an alternative embodiment, typically for use by bow hunters, inasmuch as a bow hunter is utilizing both hands normally at the same time and is not able to place the mouth portion to the mouth at desired times. Essentially, the device would be affixed to the upper garment of the bow hunter. The elongate tube would be placed against the garment and secured thereto so that the mouthpiece is positioned near the mouth of the hunter. This allows the bow hunter to turn and slightly bend the head to engage the mouthpiece so that upon coughing, the desired result is obtained without the bow hunter having to utilize either hand in the process.

The invention is simple, easy to use and is economical to manufacture. The invention provides improved elements and arrangements thereof in an apparatus for the purposes described which is inexpensive, dependable and fully effective in accomplishing its intended purposes.

Other objects, advantages and capabilities of the invention will become apparent from the following description taken in conjunction with the accompanying drawings showing the preferred embodiment of the invention.

DETAILED DESCRIPTION OF THE INVENTION

Figure 1:
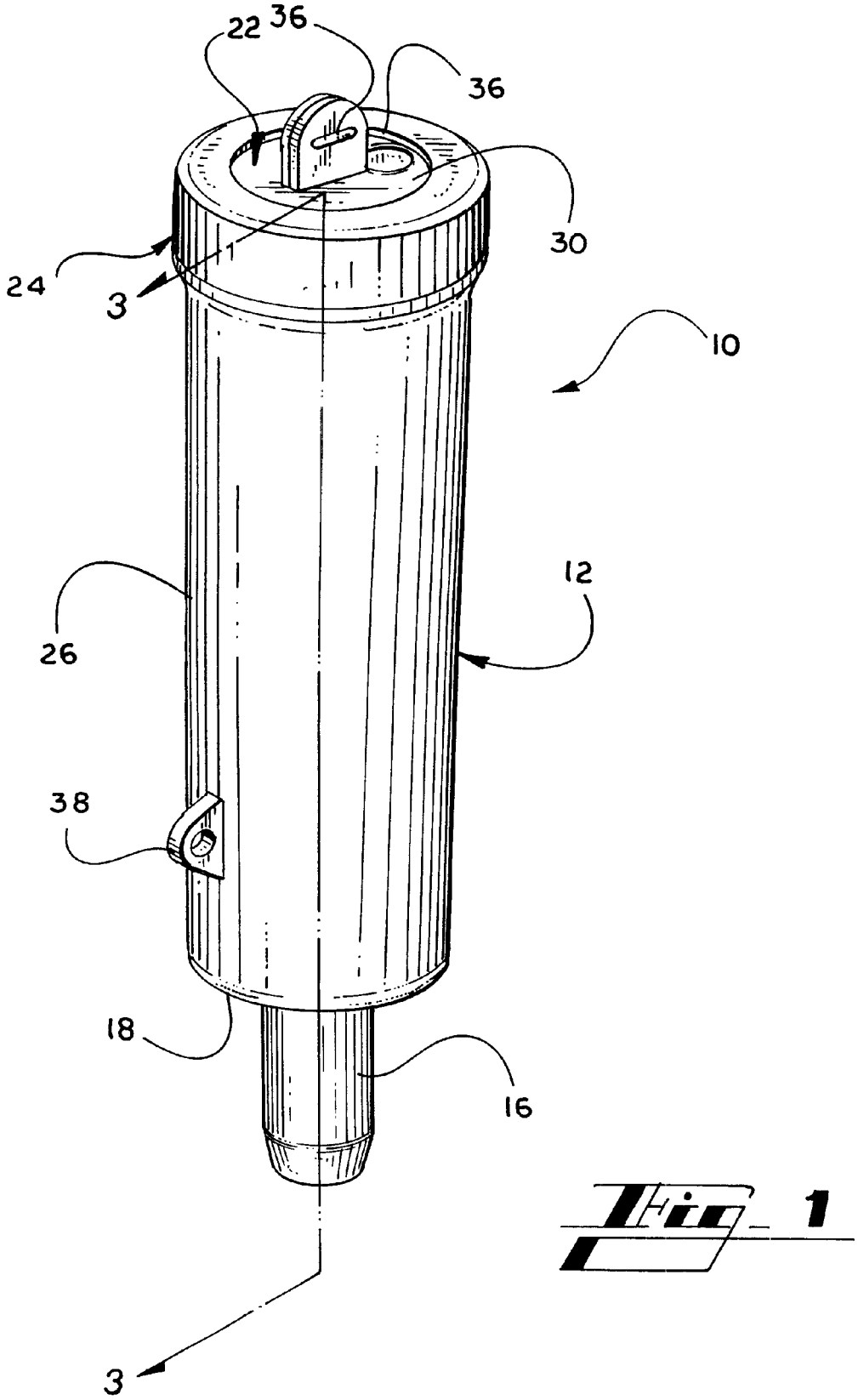
FIG. 1 is a perspective view of the invention.
Figure 2:
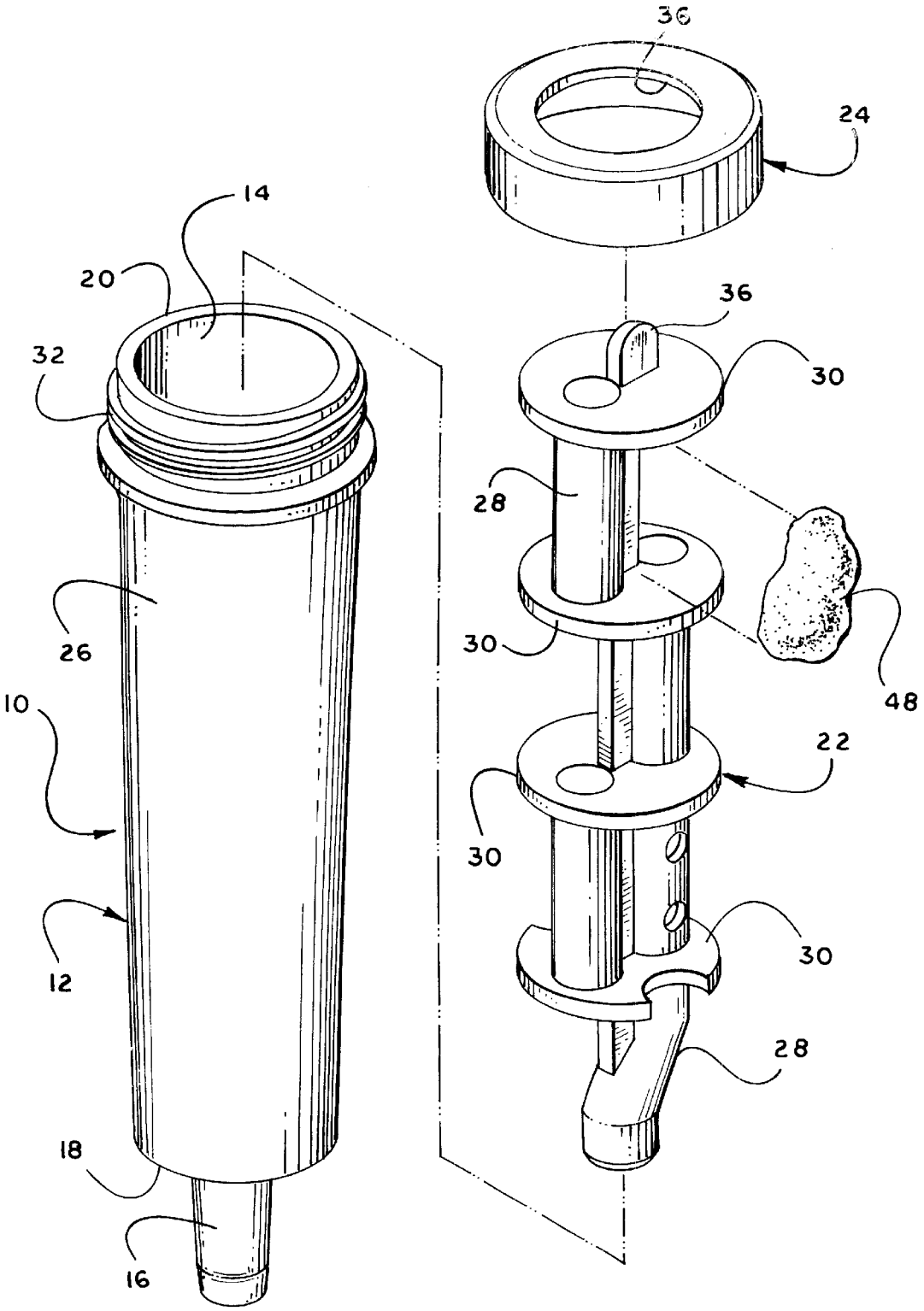
FIG. 2 is an exploded perspective view of the invention.

Referring to the drawings wherein like reference numerals designate corresponding parts throughout the several figures, reference is made first to FIGS. 1 through 4 which illustrate various components of the present invention being a cough silencer device 10 comprising a body 12 having a cavity 14 therein with a mouth portion 16 on a first end 18 and an open second end 20. An internal muffling baffling system 22 is placed within cavity 14 of body 12 and is fluidly connected to mouth portion 16. An end cap 24 is attachable to open second end 20 of body 12 to retain internal muffling baffling system 22 within cavity 14. A person, such as a hunter, can insert mouth portion 16 into their mouth and cough allowing internal muffling baffling system 22 to silence the cough.

Body 12 is cylindrical a housing 26 so that it can be easily gripped by a hand of the person. Internal muffling baffling system 22 includes a plurality of perforated offset conduits 28 having a plurality of spaced apart baffle discs 30 interconnecting the conduits 28 and the discs 30 to form a unitary structure. Within each conduit 28 is a tubular opening 28*a* therethrough which allows the generated sound to pass therethrough and to be subsequently attenuated within the defined sound chambers 29.

Open second end 20 of body 12 has external threads 32. End cap 24 has internal threads 34 to engage with external threads 32 on open second end 20 of body 12. End cap 24 has an open top 36 to allow venting of internal muffling baffling system 22 therethrough.

Internal muffling baffling system 22 further includes a finger grip 36 on end opposite from mouth portion 16 of body 12 to allow easy removal from cavity 14 of body 12 for cleaning. An eyelet 38 is formed on body 12, so that body 12 can be attached to an upper garment of the person.

Figure 3:
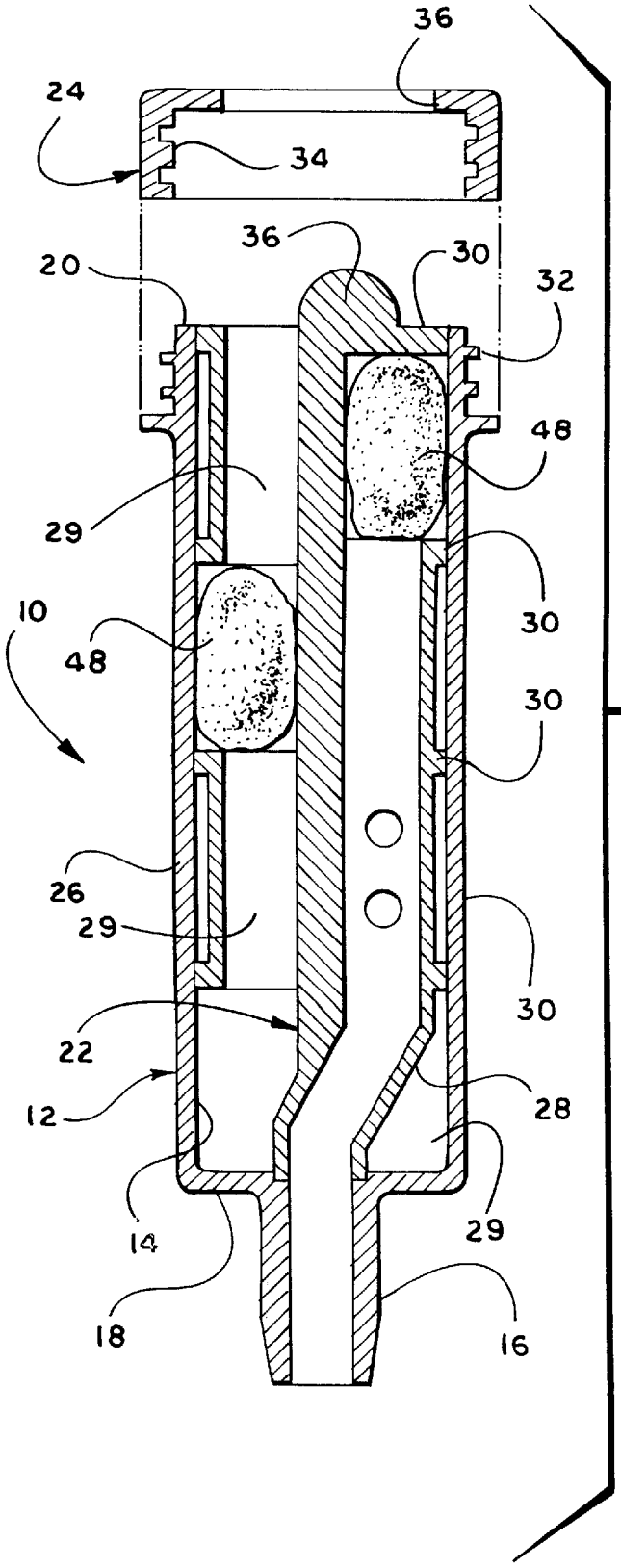
FIG. 3 is a cross sectional view taken along lines 3—3 in FIG. 1 with the end cap exploded therefrom.
Figure 4:
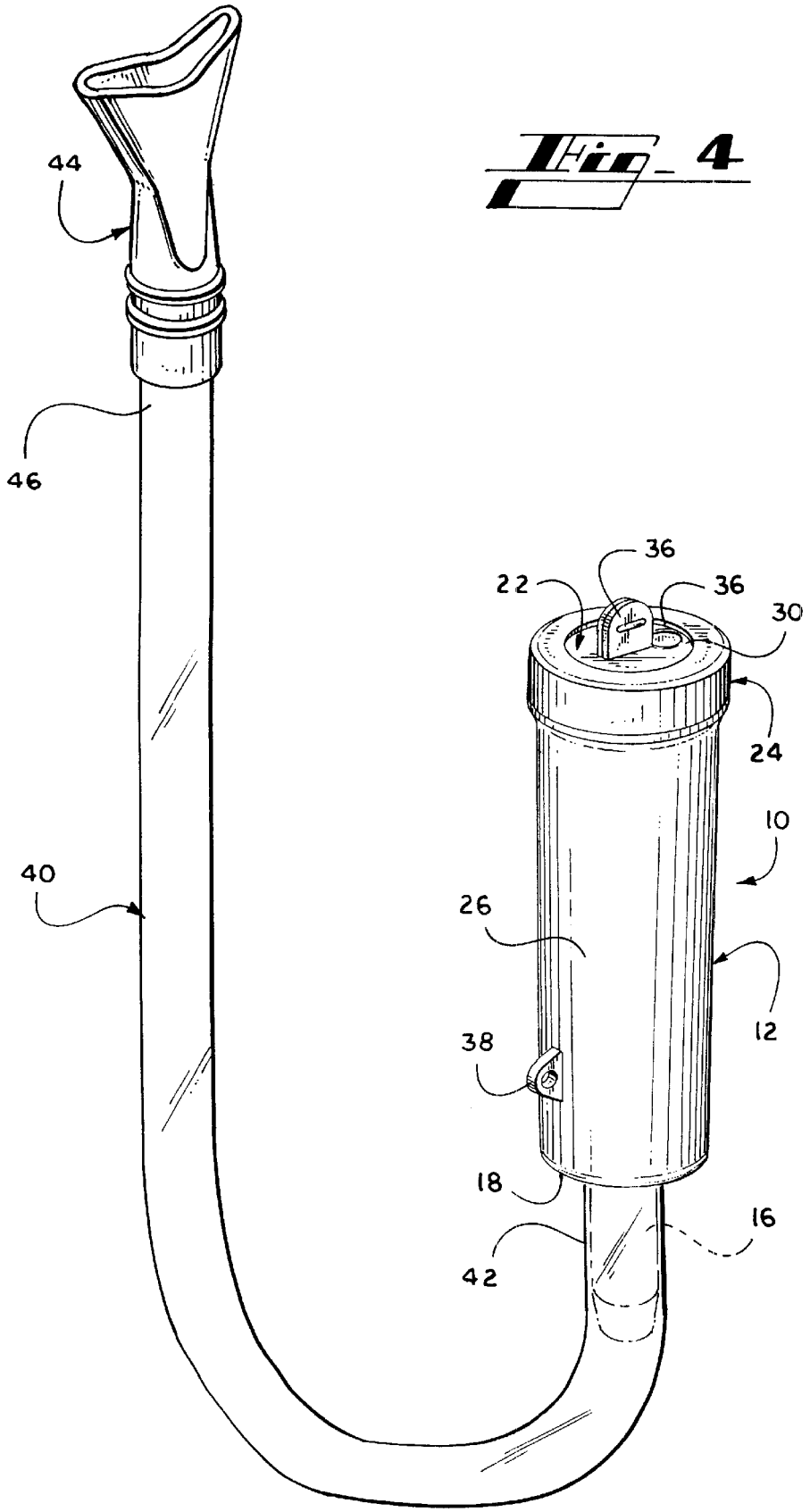
FIG. 4 is a perspective view showing an alternative embodiment being an elongate tube and mouthpiece connected thereto.

Cough silencer device 10, shown in FIG. 4, can further include an elongate tube 40 having a first end 42 attached to mouth portion 16 of body 12. A mouthpiece 44 is affixed to a second end 46 of elongate tube 40, so that the mouth of the person can engage mouthpiece 44. In this instance the person can be a bow hunter who needs both hands free for hunting. Internal muffling baffling system 22 can further contain fibrous material 48, such as cotton, interspaced between baffle discs 30, within sound chambers 29, to assist in silencing the noise of the cough (see FIGS. 2 and 3).

Body 12, internal muffling baffling system 22 and end cap 24 of cough silencer device 10, as shown in FIG. 3, are preferably fabricated out of molded plastic, however, other materials, such as wood or metal can be substituted. Elongate tube 40 and mouthpiece 44 can be made out of a flexible material, such as plastic or rubber. When a person, such as a hunter, wants to silence a cough, mouth portion 12 is placed into the mouth. Internal muffling baffling system 22 will then reduce the sound made by the cough. If the person is a bow hunter then eyelet 38 is attached to an upper garment of the person. Elongate tube 40 is attached to mouth portion 16 and mouthpiece 44 placed into the mouth of the person. The hands are now free to operate the bow.

Therefore, the foregoing is considered as illustrative only of the principles of the invention. Further, various modifications may be made of the invention without departing from the scope thereof and it is desired, therefore, that only such limitations shall be placed thereon as are imposed by the prior art and which are set forth in the appended claims.

What is claimed is:

1. A cough silencer device comprising:

a cylindrical housing body having a cavity therein with a mouth portion on a first end and an open second end, an internal muffling baffling system placed within said cavity of said body and fluidly connected to said mouth portion, the baffling system including a perforated offset conduit connected to a plurality of spaced apart baffle discs, and an end cap attachable to said open second end of said body to retain said internal muffling baffling system within said cavity, so that a person can insert said mouth portion into their mouth and cough allowing said internal muffling baffling system to silence the cough.

2. The cough silencer device as recited in claim 1, wherein said internal muffling baffling system further includes sound attenuating fibrous material interspaced between said baffle discs.

3. A cough silencer device comprising:

a cylindrical housing body having a cavity therein with a mouth portion on a first end and an open second end, an internal muffling baffling system placed within said cavity of said body and fluidly connected to said mouth portion, said internal muffling baffling system including a perforated offset conduit connected to a plurality of spaced apart baffle discs, an end cap attachable to said open second end of said body to retain said internal muffling baffling system within said cavity, so that a person can insert said mouth portion into their mouth and cough allowing said internal muffling baffling system to silence the cough, said internal muffling baffling system further including a finger grip on end opposite from said mouth portion of said body, said open second end of said body having external threads, and said end cap having internal threads to engage with said external threads on said open second end of said body, said end cap having a venting open top, and said internal muffling baffling system further including sound attenuating fibrous material interspaced between said baffle discs.

4. The cough silencer device as recited in claim 3, further including an elongate tube having a first end attached to said mouth portion of said body, and a mouthpiece affixed to a second end of said elongate tube.

* * * * *